US005351953A

United States Patent [19]

Mase

[11] Patent Number: 5,351,953

[45] Date of Patent: Oct. 4, 1994

[54] DYNAMICALLY MATCHED SET OF GOLF CLUBS AND METHOD AND APPARATUS FOR DESIGNING THE SAME USING THE INERTIA TENSOR

[76] Inventor: George T. Mase, 1008 Henry Ct., Flushing, Mich. 48433

[21] Appl. No.: 33,488

[22] Filed: Mar. 18, 1993

[51] Int. Cl.[5] ..... A63B 53/00

[52] U.S. Cl. ..... 273/77 A; 273/80 A; 273/169; 273/81 A

[58] Field of Search ..... 273/77 R, 77 A, 81 R, 273/81 A, 80 R, 80 A, 167 R, 169; 73/65

[56] References Cited

U.S. PATENT DOCUMENTS

| | | | |
|---|---|---|---|
| 1,351,768 | 9/1920 | Lawton | 273/77 A |
| 1,594,801 | 8/1926 | Stackpole . | |
| 1,953,916 | 4/1934 | Adams . | |
| 2,349,736 | 5/1934 | Knobel et al. | 273/77 A |
| 3,698,239 | 10/1972 | Everett, III | 73/65 |
| 3,703,824 | 11/1972 | Osborne et al. | 73/65 |
| 3,871,649 | 3/1975 | Kilshaw | 273/77 A |
| 4,128,242 | 12/1978 | Elkins, Jr. | 273/77 A |
| 4,212,193 | 7/1980 | Turley | 73/65 |
| 4,420,156 | 12/1983 | Campau | 273/77 A |
| 4,674,324 | 7/1987 | Benolt | 73/65 |
| 4,840,380 | 6/1989 | Kajita et al. | 273/80 A |
| 5,094,101 | 3/1992 | Chastonay | 73/65 |
| 5,120,062 | 7/1992 | Schele et al. | 273/167 F |
| 5,152,527 | 10/1992 | Mather et al. | 273/77 A |
| 5,163,681 | 11/1992 | Hodgetts | 273/77 A |

*Primary Examiner*—Benjamin H. Layno
*Assistant Examiner*—Steven B. Wong
*Attorney, Agent, or Firm*—Brooks & Kushman

[57] ABSTRACT

A set of golf clubs which are dynamically matched and a method for producing such a set. The dynamically matched set of clubs is one whose clubs meet one of the following criteria:

i) all components of the inertia tensor are substantially the same, ii) one or more of the products of inertia are substantially the same, iii) two or mroe of the components of the inertia tensor are substantially the same. Matching a component of the inertia tensor of a club consists of making that component constant for all clubs in the set or having it progressively vary through the different clubs in the set.

13 Claims, 7 Drawing Sheets

DYNAMICALLY MATCHED SET OF GOLF CLUBS AND METHOD AND APPARATUS FOR DESIGNING THE SAME USING THE INERTIA TENSOR

BACKGROUND OF THE INVENTION

1. Technical Field

This application relates to the field of a dynamically matched set of golf clubs.

2. Background of Invention

FIG. 1 shows the typical golf club comprising a shaft 30, a grip 32 located at one end of the shaft referred to as the grip or butt end 34, and a clubhead 36 located at the other end of shaft 30. The forward end of clubhead 36 is known as the toe 38 and the opposite end is known as the heel 40.

The matching of golf clubs in the past has involved both static and dynamic methods. The static method is often referred to as the swing-weight method which correlates the relative weight in the club head to the overall weight. By definition (U.S. Pat. Nos. 1,953,916 and 1,594,801) the swing-weight is the moment of the club's weight about a fulcrum 12 inches (30.48 cm) from the grip end of the club. The value of the moment is correlated to an index consisting of a letter and a number, C2, C3, . . . C9, D0, D1 . . . D9 . . ., representing increasing moment. That is, the moment generated by a D2 club is greater than the moment generated by a C2 club. A set of clubs is matched by making every club in the set a specific swing-weight. For example, a set of clubs may be matched by making all the clubs have a swing-weight of D0.

Dynamic correlation of golf clubs is a second way of matching in which the moment of inertia, I, or the radius of gyration, k, is prescribed for a set of clubs. Prescribing the moment of inertia about a given axis is tantamount to prescribing the radius of gyration about that axis because the two are related through the mass of the club, m, as follows:

$$k^2 I/m. \tag{1}$$

The value of the moment of inertia, and hence the radius of gyration, is dependent on the axis of rotation.

U.S. Pat. Nos. 4,128,242; 5,094,101; and 3,698,239 claim to match the moment of inertia of a set of golf clubs as they rotate about a single axis which may correspond to the grip end of the club, the center of gravity, or the center of percussion. The deficiency in dynamically matching clubs with these methods is that only one axis, and one corresponding moment of inertia is considered. This is not sufficient to fully characterize the dynamic response of the club since there are two remaining axes to measure the moments of inertia as well as the products of inertia since, in general, the axis of interest may not be principal axes.

In order to dynamically characterize a golf club, in accordance with this invention, one must know the mass, m, the center of gravity, G, and the inertia tensor $$I = \begin{bmatrix} I_{xx} & I_{xy} & I_{xz} \\ I_{xy} & I_{yy} & I_{yz} \\ I_{xz} & I_{yz} & I_{zz} \end{bmatrix} \tag{2}$$

where $I_{xx}$, $I_{yy}$, and $I_{zz}$ are moments of inertia about the x, y, and z axes, respectively, and $I_{xy}$, $I_{xz}$, and $I_{yz}$ are the products of inertia.

As a simple example, consider the right-cylinder of FIG. 2 as an example of the ienrtia tensor. An dynamics book (Beer and Johnson, 1988) gives the inertia tensor with respect to the centroidal, or center of gravity, axes as follows:

$$\bar{I} = \begin{bmatrix} \bar{I}_{xx} & \bar{I}_{xy} & \bar{I}_{xz} \\ \bar{I}_{xy} & \bar{I}_{yy} & \bar{I}_{yz} \\ \bar{I}_{xz} & \bar{I}_{yz} & \bar{I}_{zz} \end{bmatrix} = \begin{bmatrix} \frac{1}{2} ma^2 & 0 & 0 \\ 0 & \frac{1}{12} m(3a^2 + L^2) & 0 \\ 0 & 0 & \frac{1}{12} m(3a^2 + L^2) \end{bmatrix} \tag{3}$$

where m is the mass of the cylinder. The products of ienrtia are zero because of the symmetry of the material with respect to axes $<\overline{xyz}>$. The inertia tensor with respect to axes $<x_1y_1z_1>$ can be easily determined to be $$\begin{bmatrix} I_{x1x1} & I_{x1y1} & I_{x1z1} \\ I_{x1y1} & I_{y1y1} & I_{y1z1} \\ I_{x1z1} & I_{y1z1} & I_{z1z1} \end{bmatrix} = \begin{bmatrix} \frac{1}{2} ma^2 & 0 & 0 \\ 0 & m\left(\frac{1}{4} a^2 + \frac{1}{3} L^2\right) & \frac{1}{4} mL^2 \\ 0 & \frac{1}{4} mL^2 & m\left(\frac{1}{4} a^2 + \frac{1}{3} L^2\right) \end{bmatrix}. \tag{4}$$

In order to fully describe the dynamic response of a club, one must determine the six inertia terms $I_{xx}$, $I_{yy}$, $I_{zz}$, $I_{xy}$, $I_{xz}$, and $I_{yz}$ referred to a specific reference frame, the mass, and the center of gravity.

Once this is specified, the ienrtia tensor can be described for any other axis parallel to the centroidal axes by using the parallel axis therorem (Beer and Johnson, 1988), $$\begin{aligned} I_{x1x1} &= I_{\overline{xx}} + mx^2 & I_{y1y1} &= I_{\overline{yy}} + my^2 \\ I_{z1z1} &= I_{\overline{zz}} + mz^2 & I_{x1y1} &= I_{\overline{xy}} + mxy \\ I_{x1z1} &= I_{\overline{xz}} + mxz & I_{y1z1} &= I_{\overline{yz}} + myz, \end{aligned} \tag{5}$$

where $<\overline{xyz}>$ and $<x_1y_1z_1>$ are centroidal axes and an arbitrary set of axes parallel to the centroidal axes, respectively. In the second term of each of the six equations, x, y, and z are the perpendicular distance that $\bar{x}$ is from $x_1$, $\bar{y}$ is from $y_1$, and $\bar{z}$ is from $z_I$, respectively.

If the inertia tensor components are desired at an axis, $<x_2y_2z_2>$, which is neither at the centroid nor has all three axes parallel to the centroidal axes, $<\overline{xyz}>$, then the following transformation must be applied to the inertia tensor after the parallel axis theorem, Eq. 5, has been applied:

$$\begin{bmatrix} I_{x2x2} & I_{x2y2} & I_{x2z2} \\ I_{x2y2} & I_{y2y2} & I_{y2z2} \\ I_{x2z2} & I_{y2z2} & I_{z2z2} \end{bmatrix} = \begin{bmatrix} a_{11} & a_{12} & a_{13} \\ a_{21} & a_{22} & a_{23} \\ a_{31} & a_{32} & a_{33} \end{bmatrix} \begin{bmatrix} I_{x1x1} & I_{x1y1} & I_{x1z1} \\ I_{x1y1} & I_{y1y1} & I_{y1z1} \\ I_{x1z1} & I_{y1z1} & I_{z1z1} \end{bmatrix} \times \begin{bmatrix} a_{11} & a_{21} & a_{31} \\ a_{12} & a_{22} & a_{32} \\ a_{13} & a_{23} & a_{33} \end{bmatrix} \quad (6)$$

where $$\alpha_{11}=\cos(x_2,x_1),\alpha_{12}=\cos(x_2,y_1),\alpha_{13}=\cos(x_2,z_1)$$

$$\alpha_{21}=\cos(y_2,x_1),\alpha_{31}=\cos(z_2,x_1),\alpha_{32}=\cos(z_2,y_1) \quad 7)$$

(Ref. Mase and Mase, 1992).

SUMMARY OF THE INVENTION

This invention has the following primary objectives:

1. Provide a set of golf clubs which are dynamically matched and a method for producing such a set. The dynamically matched set of clubs is one whose clubs meet one of the following criteria:
   - i) all components of the inertia tensor are substantially the same
   - ii) one or more of the products of inertia are substantially the same
   - iii) two or more of the components of the inertia tensor are substantially the same Matching a component of the inertia tensor of a club consists of making that component constant for all clubs in the set or having it progressively vary through the different clubs in the set.

2. Provide a set of golf club heads which are dynamically matched and a method for producing such a set. The dynamically matched set of club heads is one whose club heads meet one of the following criteria:
   - i) all components of the inertia tensor are substantially the same
   - ii) one or more of the components of the inertia tensor are substantially the same Matching a component of the inertia tensor of a club head consists of making that component constant for all clubs in the set or having it progressively vary through the different clubs in the set.

3. Provide an apparatus and a method for measuring the components of the inertia tensor for golf clubs and golf club heads. This method allows for the evaluation of the inertia tensor about any set of reference axes.

DETAILED DESCRIPTION OF THE INVENTION

The dynamic response of a golf club is extremely important with regards to the performance of the club. As a golfer draws the club back from address, its acceleration produces a particular feel to the player. During the downswing, the club is further accelerated increasing the forces the golfer feels. At the impact of the golf club with the ball, the dynamic properties of the club determine the returned impulse that the golfer feels from which he or she judges the quality of the shot. Finally, the dynamic properties of the club and club head affect the ballistics of launching of the ball. All of these are determined, to a great extent, by the inertia tensor of the golf club and the golf club head.

A matched set of golf clubs or club heads may be obtained in one of two ways. First, a specific club from the set is chosen, say a 5 iron, whose playing characteristics are desirable. The inertia tensor is evaluated for this club or club head and used to match all the other clubs in the set according to the method of this invention. Woods and irons can be considered separately. That is, the irons may be matched to the 5 iron while the woods are matched to the 4 wood.

A second way to dynamically match a set of clubs is to analytically determine a desired set of inertia components from which the inertia components for all the clubs or club heads of the set are determined.

Matching a component of the inertia tensor consists of any one of the following conditions: i) making that component substantially the same for all the dubs in the set, or, ii) making that component vary linearly, quadratically, or in some other prescribed manner throughout the clubs in the set.

Figure 1:
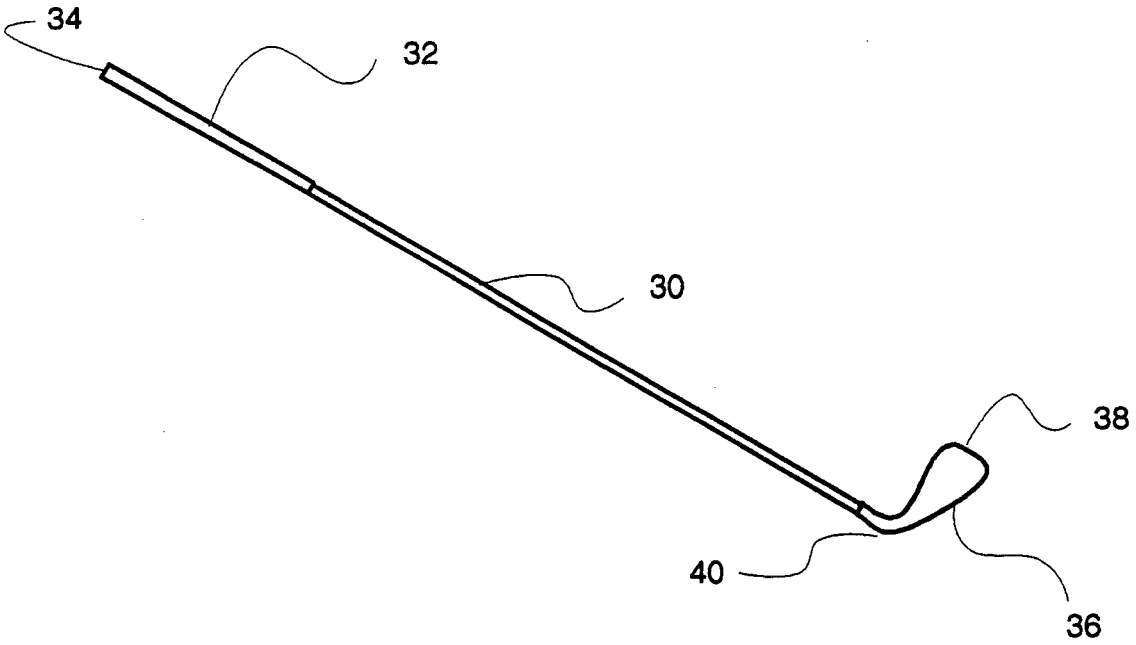
FIG. 1 illustrates a golf club with some of the fundamental components identified.
Figure 2:
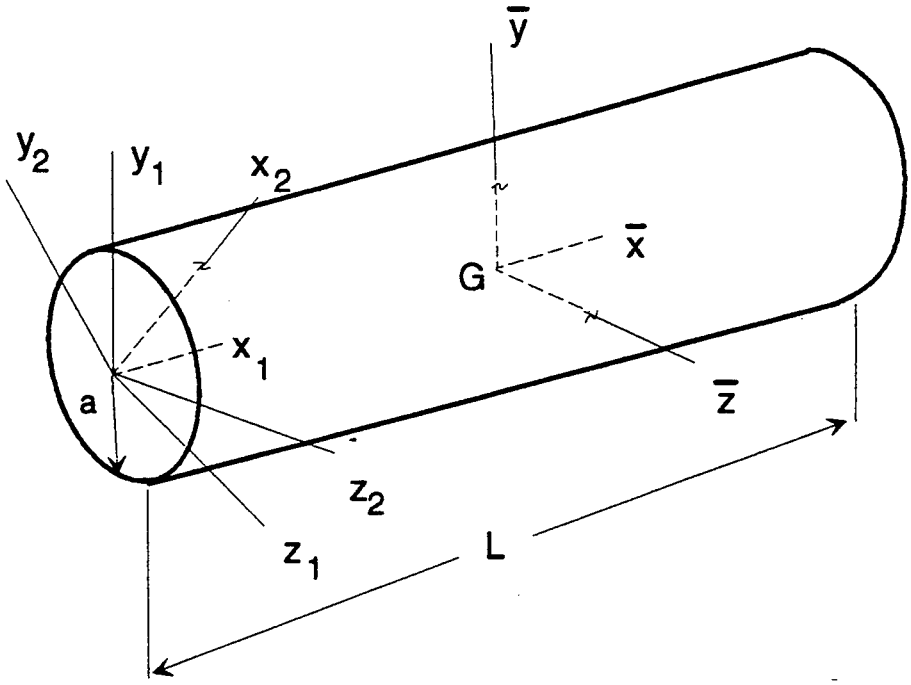
FIG. 2 illustrates a fight-cylinder along with three sets of axes used to demonstrate the inertia tensor.
Figure 3:
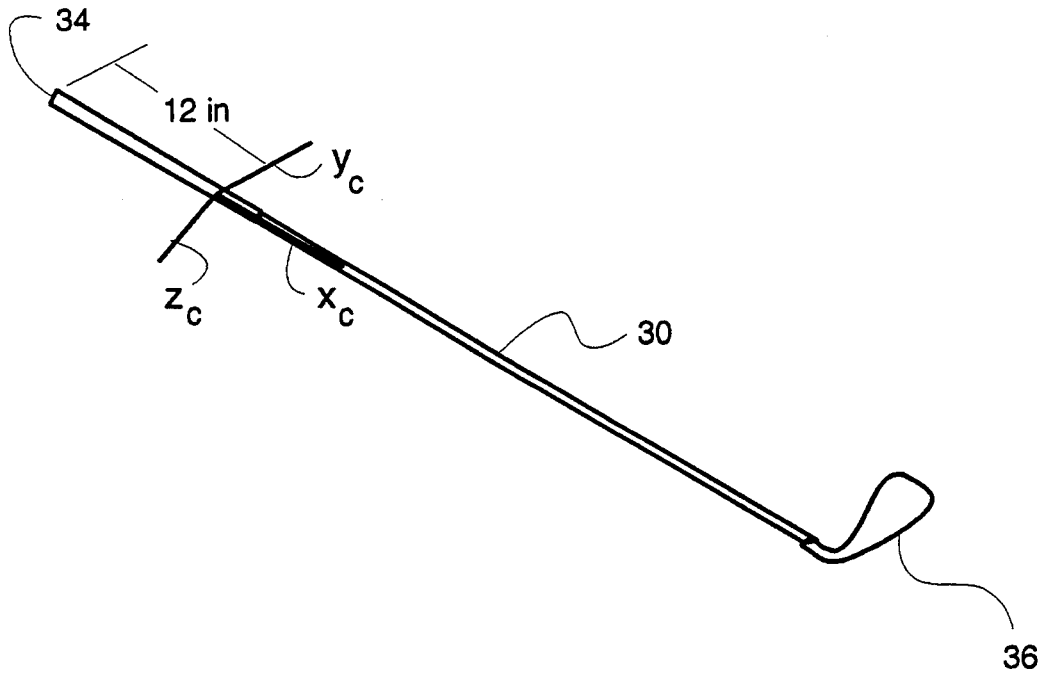
FIG. 3 illustrates the axes used to evaluate the inertia tensor of a golf club in accordance with the present invention.
Figure 4A:
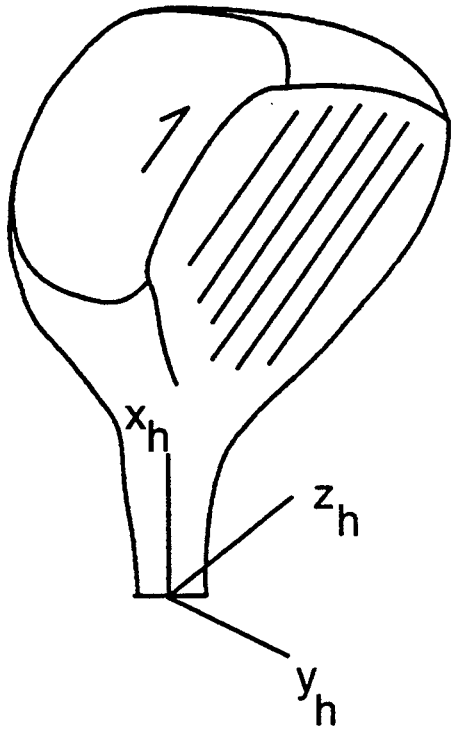
FIG. 4(*a*) illustrates the axes used to evaluate the inertia tensor of a golf club head known as a "wood", and FIG. 4(*b*) shows the same for an "iron", in accordance with the present invention.
Figure 4B:
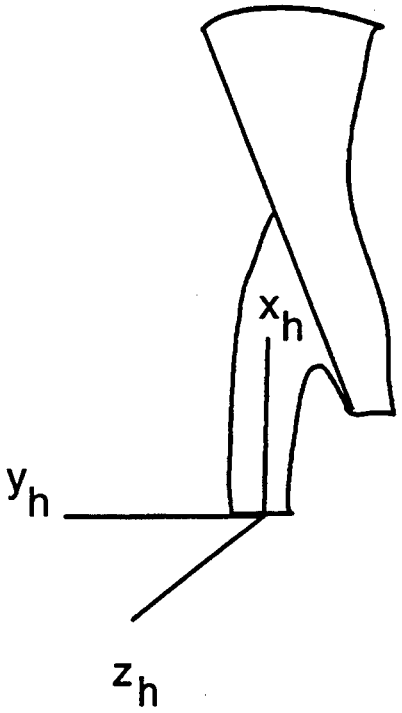

In order to discuss the inertia tensor of golf clubs and golf club heads, a set of axes must be chosen from which the inertia tensor is referred to. For a club, the origin of the axes used to clefme the inertia tensor is located in the center of the shaft's cross-section, 12 inches (30.48 cm) from the butt end of the club with the $x_c$ axis directed down the shaft, the Yc axis directed forward towards the target, and the $z_c$ axis making up a right-handed coordinate system. These directions are shown in FIG. 3. Axes for determining the inertia tensor for club heads are shown in FIG. 4 and parallel the definitions for the golf club. The $x_h$ axis is at the top end of the neck directed in a line with the shaft axis. The $y_h$ and $z_h$axes are directed in the same direction as their counterparts for the club, but they emanate from an origin at the top of the club head neck.

It must be noted that the inertia tensor for a club or club head is unique to the club or club head. If the inertia tensor is determined using a different set of reference axes the numerical values of the tensor components may be different, but the inertia tensor is the same. For two different sets of reference axes, the two sets of inertia tensor components vary according to Eqs. 5 and 6.

The following gives a few examples of the many ways to dynamically match sets of clubs using the method of this invention:

Example 1

Figure 5:
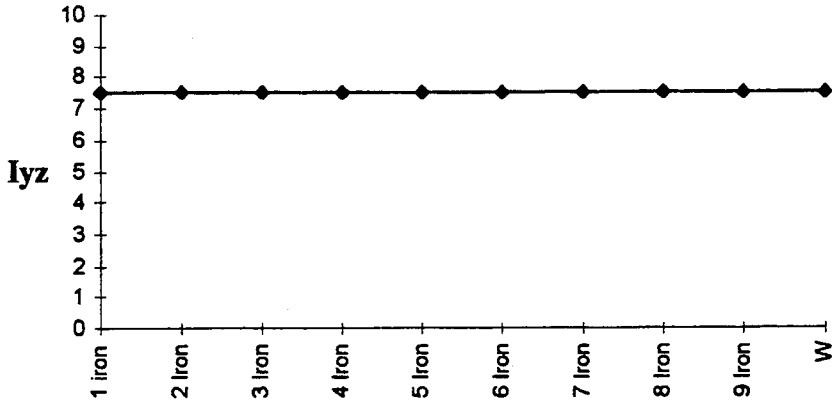
FIG. 5 illustrates a set of golf clubs dynamically matched by having one of the products of inertia substantially the same for all clubs in the set per the present invention.

A set of clubs is dynamically matched by having the product of inertia $I_{yz}$ set at a particular value as shown in FIG. 5. All other components of the inertia tensor are unspecified from club to club.

Example 2

Figure 6:
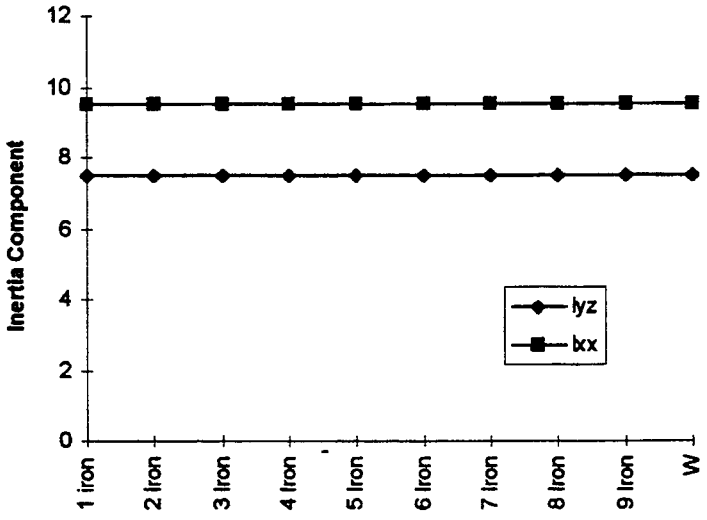
FIG. 6 illustrates a set of golf clubs dynamically matched by having one of the products of inertia and one of the moments of inertia the same for all the clubs in the set per the present invention.

A set of clubs is dynamically matched by having the moment of inertia $I_{xx}$ and the product of inertia $I_{yz}$ set at a panicular value as shown in FIG. 6. All other components of the inertia tensor are unspecified from club to club.

Example 3

Figure 7:
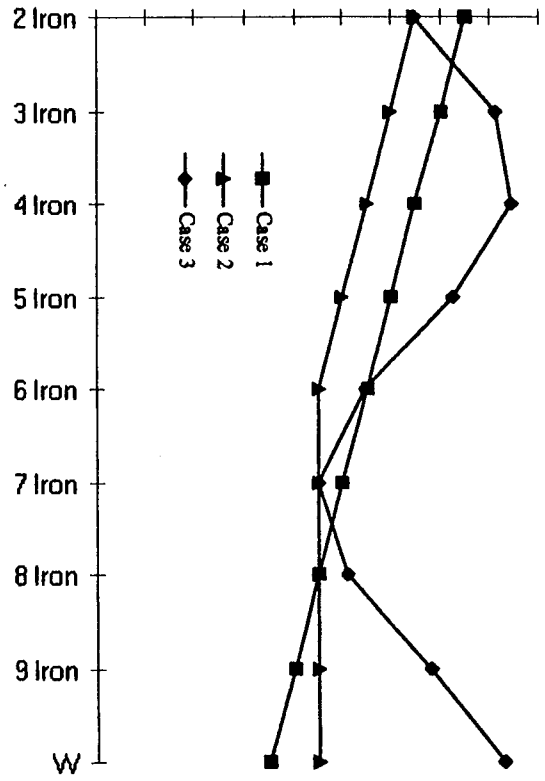
FIG. 7 illustrates three different ways of dynamically matching a set of clubs using the method of this invention.

A set of clubs is dynamically matched by having the product of inertia $I_{xy}$ vary in a prescribed manner from club to club in the set. Three examples of variation are shown in FIG. 7. All other components of the inertia tensor are unspecified from club to club.

Another pan of this invention is an apparatus that is used to measure all six components of the inertia tensor for both clubs and club heads.

Newtonian dynamics is sufficient to measure the inertia tensor. In particular, the time rate of change of angular momentum is equal to the sum of the applied moments:

$$\Sigma M = H = \frac{dH}{dt} + \omega \times H. \tag{8}$$

The components of angular momentum can be written in tenns of the inertia components and the angular velocity as follows:

$$H_x = I_{xx}\omega_x - I_{xy}\omega_y - I_{xz}\omega_z$$

$$H_y = -I_{yx}\omega_x + I_{yy}\omega_y - I_{yz}\omega_z$$

$$H_z = -I_{zx}\omega_x - I_{zy}\omega_y + I_{zz}\omega_z \tag{9}$$

where $\omega_x$, $\omega_y$, and $\omega_z$ are the components of the angular velocity in the x, y, and z directions, respectively.

It is Eq. 8 that leads to an apparatus to measure all the inertia components of a club or club head. The moments of inertia of the club or club head are determined by vertically aligning the $x_c$, $y_c$, and $z_c$ (or $x_h$, $y_h$, and $z_h$) axes and applying a known moment to the club or club head and measuring the angular accelerations $\alpha_x$, $\alpha_y$, and $\alpha_z$. In these three cases, Eq. 10 reduces to $$M_x = I_{xx}\alpha_x,\ M_y = I_{yy}\alpha_y,\ M_z = I_{zz}\alpha_z \tag{10}$$

Figure 8:
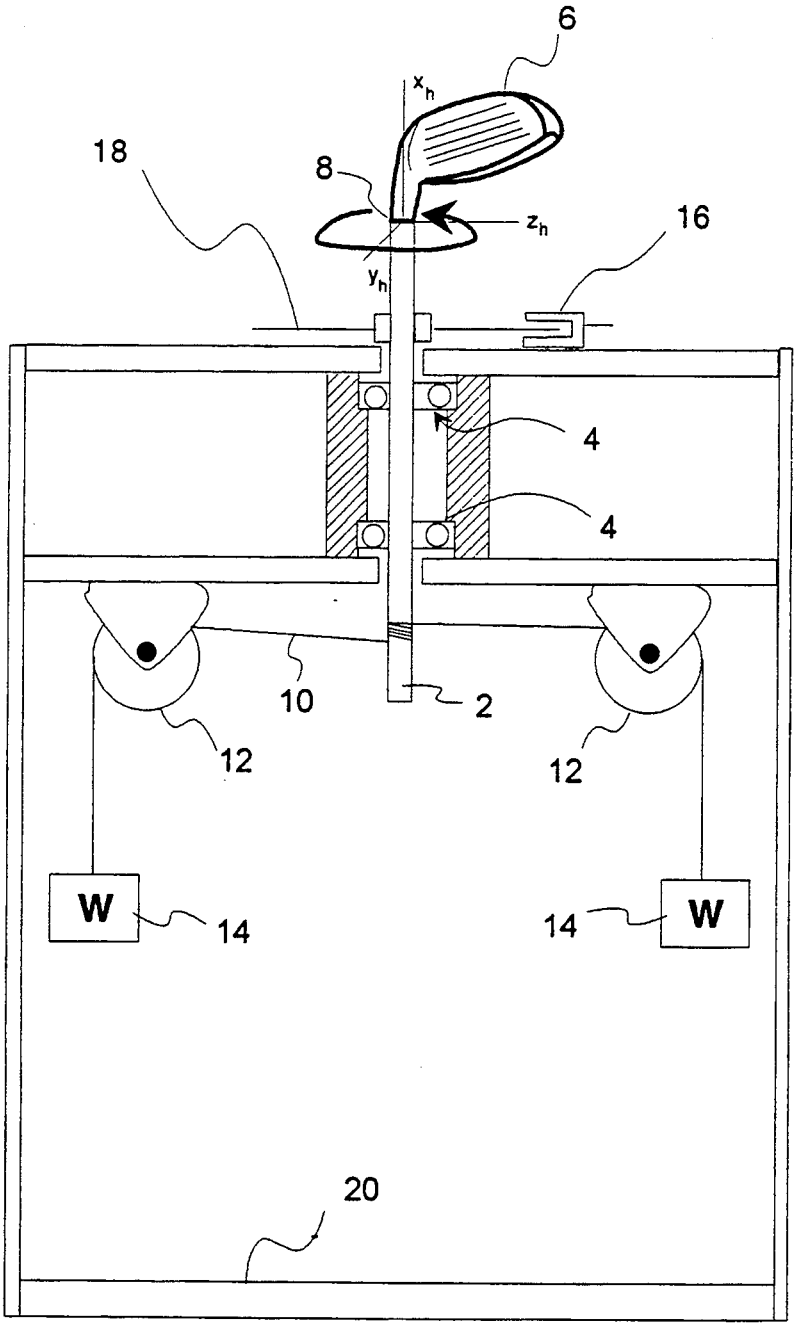
FIG. 8 illustrates an apparatus, which is in accordance with the present invention, which can be used to measure all the components of the inertia tensor for golf clubs and golf club heads.

The apparatus for measuring these three cases is shown in FIG. 8. A 0.5 inch diameter (1.27 cm), 6 inch (15.24 cm) long bar 2 is held vertical by a pair of spaced ball bearings assemblies 4. Ball bearings 4 are sufficient because loading in the vertical direction is minimal. The club head 6 is attached the top of the bar 2 via a machined connecting fixture 8. A known moment is applied to the bottom of the bar by wrapping a string 10 around the bar, passing the string over pulleys 12, and attaching known weights 14 to the two string ends. The weights 14 create a tension in the string which, in turn, generates a moment on the lower end of the bar. This moment causes the bar and club head to have an angular acceleration about axis $x_h$ as shown in FIGS. 8 and 10(*a*).

The moment on the bar is found by applying Newton's 2nd Law to the weights and, for the 0.5 inch diameter (1.27 cm) bar, this moment is given by (in English units)

$$M = \frac{1}{2} W\left(1 - \frac{\alpha}{4g}\right) \tag{11}$$

where g is the acceleration due to gravity (32.2 ft/s$^2$ or 9.81 m/s$^2$).

Figure 9:
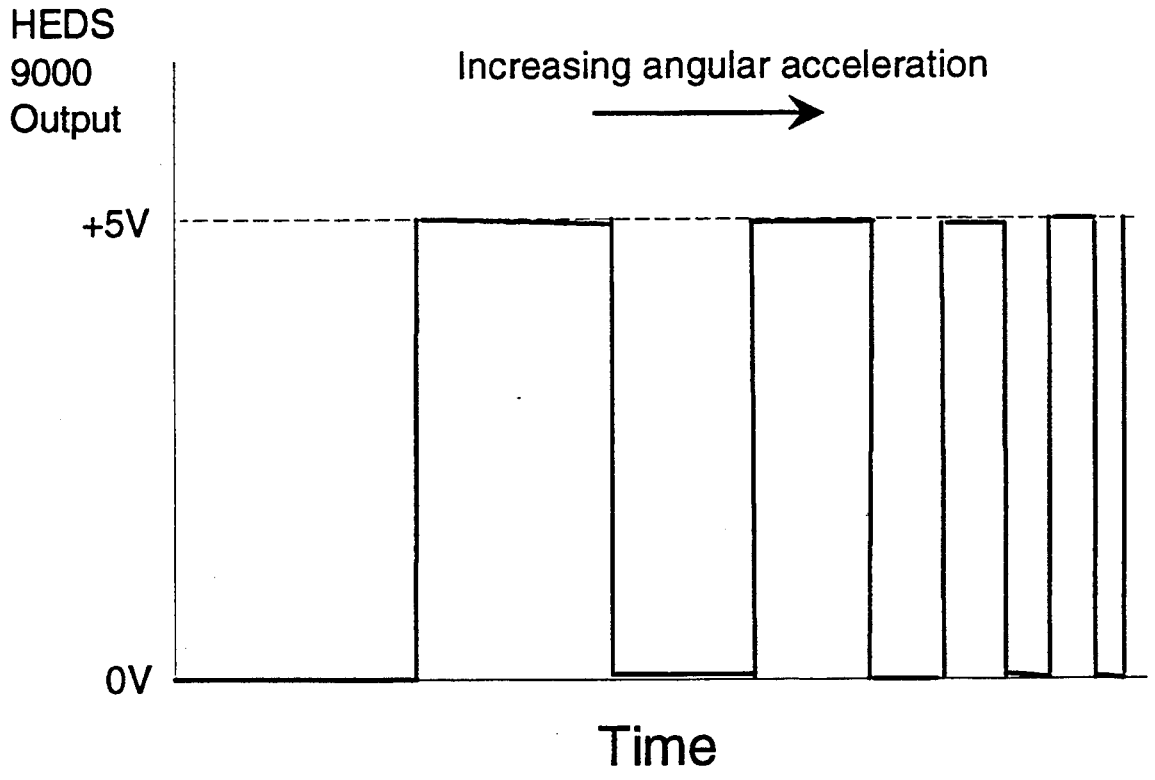
FIG. 9 illustrates the raw signal which the apparatus of FIG. 8 produces.
Figure 10A:
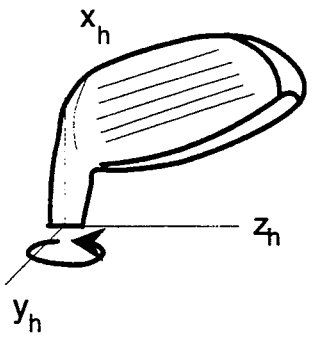
FIGS. 10(*a*), 10(*b*), 10(*c*), 10(*d*), and 10(*e*), respectively, illustrates the five different club head configurations needed for determining all six of the components of the inertia tensor in accordance with the present invention.
Figure 10B:
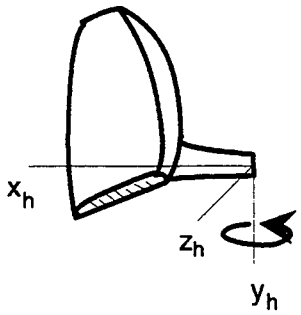
Figure 10C:
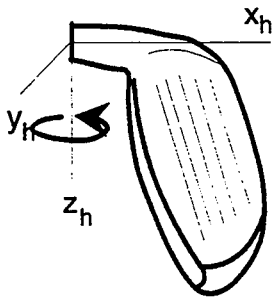
Figure 10D:
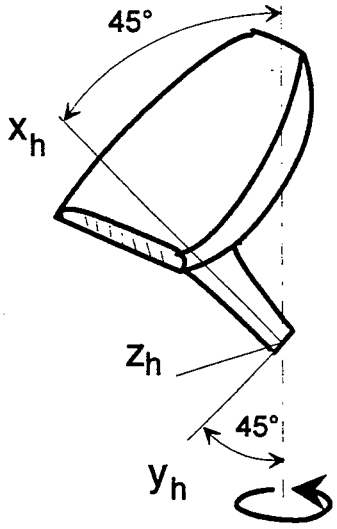
Figure 10E:
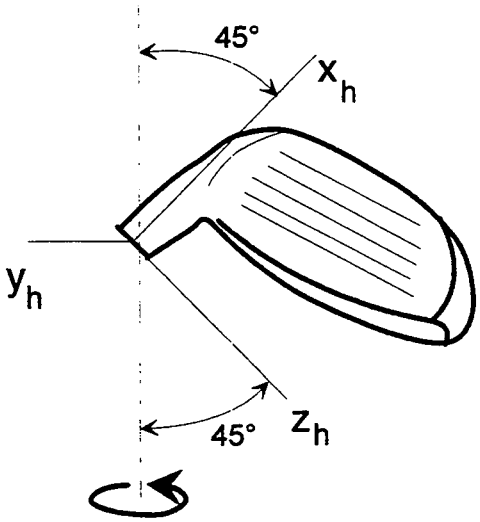

Angular acceleration is calculated from a measured encoder square-wave signal (shown in FIG. 9) generated by a Hewlett-Packard HEDS 9000 encoder 16 and a 1,000 cpr HEDS 6100 optical disk 18. The HEDS 9000 requires a regulated 5 volt power supply. With a light weight attached to the strings the encode signal goes from 0 to ~1100 Hertz before the weights hit the base 20 of the apparatus. Each time the output from the HEDS 9000 goes from 0 V to +5 V the bar and club head have rotated 0.360 degrees. Data reduction of this signal easily gives $\theta(t)$, $\omega(t)$, and $\alpha(t)$. In view of Eqns. 10 and 11 we see that $\alpha$ is constant since $I_{xx}$, W, and g are constants. Thus $$I_{xx} = \frac{1}{2}\ \frac{W}{\alpha}\left(1 - \frac{1}{4g}\right) - I_{bar} \tag{12}$$

where $I_{xx}$ is the moment of inertia of the club head and $I_{bar}$ is the moment of inertia of the bar and fixturing.

Moments of inertia $I_{yy}$ and $I_{zz}$ are measured in a similar manner except with the club head positioned differently as depicted in FIG. 10(*b*) and 10(*c*), respectively.

Measurement of the products of inertia provides a more challenging task; however, the same apparatus is used with minor fixture changes. Equations resulting from the test set-ups described below which are used for determining the products of inertia are coupled and not nearly as simple as those used to find the moments of inertia.

In the first test, the club head is held in place on the top of the bar as previously described, and the bar is rotated 45° about the z axis from the position shown in FIG. 10(*a*). Eqns. 10 become $$M - I_{xx}\alpha = \alpha I_{xy} + \frac{\omega^2}{\sqrt{2}} I_{xz} - \frac{\omega^2}{\sqrt{2}} I_{yz} \quad (13)$$

$$M - I_{yy}\alpha = \alpha I_{xy} - \frac{\omega^2}{\sqrt{2}} I_{xz} + \frac{\omega^2}{\sqrt{2}} I_{yz}$$

$$\frac{\omega^2}{\sqrt{2\alpha}} (I_{yy} - I_{xx}) = I_{yz} - I_{xz}$$

after substituting $$\alpha_x = \frac{\alpha}{\sqrt{2}}, \alpha_y = -\frac{\alpha}{\sqrt{2}}, \omega_x = \frac{\omega}{\sqrt{2}}, \omega_y = -\frac{\omega}{\sqrt{2}},$$

$$M_x = \frac{M}{\sqrt{2}}, M_y = -\frac{M}{\sqrt{2}}$$

where variablers without subscripts are associated with the axis of rotation of the bar on the apparatus and variables with subscripts are associated with the axes attached to the club head. Thus, variables without subscripts are those measured by the apparatus shown in FIG. 8. The three scalar equations on Eq. 13 have the three products of inertia as unknowns since the moment, M, and the products of inertia, $I_{xx}$, $I_{yy}$, and $I_{zz}$ are known from previous tests. However, the products cannot be solved directly from Eq. 13 because the system of equations is indeterminate. By substitution one of the products of inertia is found to be given by $$I_{xy} = \frac{M}{\alpha} - \frac{1}{2}(I_{xx} + I_{yy}) - I_{bar} \quad (14)$$

In order to get the rest of the products of inertia, another test configuraiton is run with the club head rotated 45° about the y axis from thk position shown in FIG. 10(*a*). In this case, Eqns. 10 become $$M - I_{xx}\alpha = -\frac{\omega^2}{\sqrt{2}} I_{xy} + \alpha I_{xz} + \frac{\omega^2}{\sqrt{2}} I_{yz} \quad (15)$$

$$\frac{\omega^2}{\sqrt{2\alpha}} (I_{xx} - I_{zz}) = -I_{xy} + I_{yz} -$$

$$M + I_{yy}\alpha = -\frac{\omega^2}{\sqrt{2}} I_{xy} - \alpha I_{xz} + \frac{\omega^2}{\sqrt{2}} I_{yz}$$

which again is indeterminate for all three products of inertia but can be solved to determine $$I_{xz} = \frac{M}{\alpha} - \frac{1}{2}(I_{xx} + I_{zz}) - I_{bar}. \quad (16)$$

With $I_{xy}$ and $I_{xz}$ known it is trivial to go back to Eq. 13 or 15 and solve for $I_{yz}$.

The 45° rotation of the club head about the z and y axes is not unique for determining the products of inertia, but rather convenient with regards to the equations these configurations produce.

The method for determining the six components of a golf club's inertia tensor follows the exact same procedure as described above. Different fixmring is used to hold the club 12 inches (30.48 cm) from the butt end. All five orientations used for determining club head inertia terms are used for determining club inertia terms by replacing $x_h$, $y_h$, and $z_h$ with $x_c$, $y_c$, and $z_c$, respectively.

The apparatus and invention can be used to determine the moments and products of inertia using the period of oscillation by simple modifications. At the bottom of the 0.5 inch diameter (1.27 cm) bar the string can be replaced with a torsional spring which has one end fitting in a hole in the bar and the other end fitting in the middle horizontal plate. The spring provides the restoring force to cause the club or club head to oscillate about its equilibrium position. A Hewlett-Packard Quadrature Decoder/Counter Interface IC HCTL-2016 is needed in the electronic signal preparation to distinguish between counterclockwise and clockwise motion.

What is claimed is:

1. A method of producing a dynamically matched set of golf clubs, including the following steps:

(a) selecting a reference club having an inherent inertia tensor, (b) determining the inertia tensor for the reference club about a preselected reference axis of said reference club;

(c) selecting the club head, shaft, and grip for each of the clubs in the set so that one of the following criteria is met:

i) at least one of the products of inertia of the reference club is substantially matched in accordance with a predetermined relationship with the remaining clubs in the said set; and ii) at least two of the inertia tensor components of the reference club are substantially matched in accordance with a predetermined relationship with the remaining clubs in the said set.

2. The method of claim 1 wherein said predetermined relationship includes any one of the following:

(a) maintaining said at least one product of inertia constant; and (b) linearly varying said at least one product of inertia.

3. The method of claim 2 wherein the said reference club is an iron.

4. The method of claim 2 wherein the said reference club is a wood.

5. The method of claim 1 wherein the inertia tensor is determined about the center of gravity.

6. The method of claim 1 wherein the inertia tensor is determined about the center of percussion.

7. A method of producing a dynamically matched set of golf club heads, including the following steps:

(a) selecting a reference club head having an inherent inertia tensor;

(b) determining the inertia tensor for the reference club head about a preselected reference axis of said reference club head;

(c) selecting the club head for each of the club heads in the set so that one of the following criteria is met:

i) at least one of the products of inertia of the reference club head is substantially matched in accordance with a predetermined relationship with the remaining club heads in the said set; and ii) at least two of the inertia tensor components of the reference club head are substantially matched in accordance with a predetermined relationship with the remaining club heads in the said set.

8. The method of claim 7 wherein said predetermined relationship includes any one of the following:

(a) maintaining said at least one product of inertia constant; and (b) linearly varying said at least one product of inertia.

9. The method of claim 8 wherein the said reference clubhead is an iron.

10. The method of claim 8 wherein the said reference club head is a wood.

11. The method of claim 7 wherein the inertia tensor is determined about the center of gravity.

12. A dynamically matched set of golf clubs, each golf club in said set having an inherent inertia tensor represented by the following equation:

$$I = \begin{bmatrix} I_{xx} & I_{xy} & I_{xz} \\ I_{xy} & I_{yy} & I_{yz} \\ I_{xz} & I_{yz} & I_{zz} \end{bmatrix}$$

wherein $I_{xx}$, $I_{yy}$, and $I_{zz}$ are moments of inertia and $I_{xy}$, $I_{xz}$, and $I_{yz}$ are the products of inertia, each golf club in said set including one of the following criteria:

(i) at least one of the products of inertia is matched in accordance with a predetermined relationship with the remaining clubs in said set; and (ii) at least two of the inertia tensor components are matched in accordance with a predetermined relationship with the remaining clubs in said set.

13. The invention of claim 12 wherein only the golf club heads are matched in accordance with one of said criteria.

* * * * *